United States Patent [19]

Feldman

[11] 4,375,311

[45] Mar. 1, 1983

[54] DIODE CONNECTOR

[75] Inventor: Steven Feldman, Seminole, Fla.

[73] Assignee: AMP Incorporated, Harrisburg, Pa.

[21] Appl. No.: 204,107

[22] Filed: Nov. 5, 1980

[51] Int. Cl.[3] ..... H01R 9/10

[52] U.S. Cl. ..... 339/112 R; 339/147 R; 339/244 UC

[58] Field of Search ..... 339/244 R, 244 B, 244 UC, 339/112 R, 147 R, 147 C, 202, 249 B, 272 B

[56] References Cited

U.S. PATENT DOCUMENTS

| | | | |
|---|---|---|---|
| 2,964,726 | 12/1960 | Michals | 339/244 R X |
| 3,638,073 | 1/1972 | Bernstein | 339/112 R |
| 3,771,112 | 11/1973 | Thompson et al. | 339/244 B |
| 4,113,341 | 9/1978 | Hughes | 339/147 R |

FOREIGN PATENT DOCUMENTS

| | | | |
|---|---|---|---|
| 787887 | 7/1935 | France | 339/244 B |
| 86698 | 9/1920 | Switzerland | 339/202 |

OTHER PUBLICATIONS

Electrical World, May 30, 1955, p. 30.

*Primary Examiner*—Joseph H. McGlynn
*Attorney, Agent, or Firm*—F. Brice Faller

[57] ABSTRACT

Connector for in-line electrical device utilizes a pair of binding post type terminals mounted in a housing. The posts have coplanar diametric slots profiled in free ends thereof and lying in the longitudinal center plane of the housing. Caps profiled to screw onto the posts for termination each have an axial dowel therein sized to prevent the slots from collapsing as the caps are screwed down.

10 Claims, 6 Drawing Figures

DIODE CONNECTOR

BACKGROUND OF THE INVENTION

Field of the Invention

The instant invention relates to an in-line connector for an electrical component and particularly to a connector for a diode in a power circuit.

A diode is a PN junction semi-conductor which blocks voltage of one polarity and allows current to flow when voltage of an opposite polarity is applied. It may be wired across an electro-motive force (emf) in order to act as an open switch when the emf is of one polarity and to act as a closed switch if the emf is of opposite polarity. This property is quite useful in solar cell technology. Individual wafers or cells are connected in banks called panels which may be wired in series or parallel with each other to achieve desired current and voltage outputs. The cells are quite fragile, and damage to any one may cause the panel to present an impedance, at which time it would be desirable to bypass the panel until the cell or panel can be replaced. A diode in parallel with each panel and reverse biased in relation to its output in a string of series connected panels will pass current along the string, bypassing any failed panel in the string.

A diode in a circuit tends to dissipate power as heat which can adversely affect its electrical characteristics. This is particularly true of a diode installed in a bank of solar panels at high noon on a sunny day. Thus it is desirable to provide means for dissipating heat from the diode. Means for dissipating heat should be consistent with objectives of protecting the diode from the elements and providing an in-line connector which is electrically isolated and may be readily serviced in the field, in an economical package.

SUMMARY OF THE INVENTION

The present invention utilizes a pair of specially designed identical binding post type terminals each consisting of a slotted cylindrical post and a cap. The posts are mounted in an elongated housing or base on either side of a central diode receiving compartment. An axial lead diode package having wire leads protruding from either end thereof is placed between the posts with the leads entering diametric slots in the posts. Caps are screwed onto the posts in order to terminate wires entering the housing from either end, and a cover is fitted to the housing to seal out moisture. The posts are made of metal and are designed so that a diode may be very closely accommodated therebetween thus providing a short thermal path between the semiconductor junction and heat dissipating elements, such as the terminals and wires of the connector. The terminals are massive and closely accommodated by a relatively thin walled base to maximize heat dissipation through the base and cover.

A primary objective of the instant diode connector is to dissipate heat from a diode which is in a plastic housing.

The objective of field serviceability is achieved by providing for field installation of a diode by merely turning two screw caps and snapping a cover on the housing for environmental protection. Removal of the diode is facilitated by providing access to the diode leads.

The accomplishment of these and other objectives will be apparent from examining the drawings and description which follow.

DETAILED DESCRIPTION OF THE PREFERRED EMBODIMENT

Figure 1:
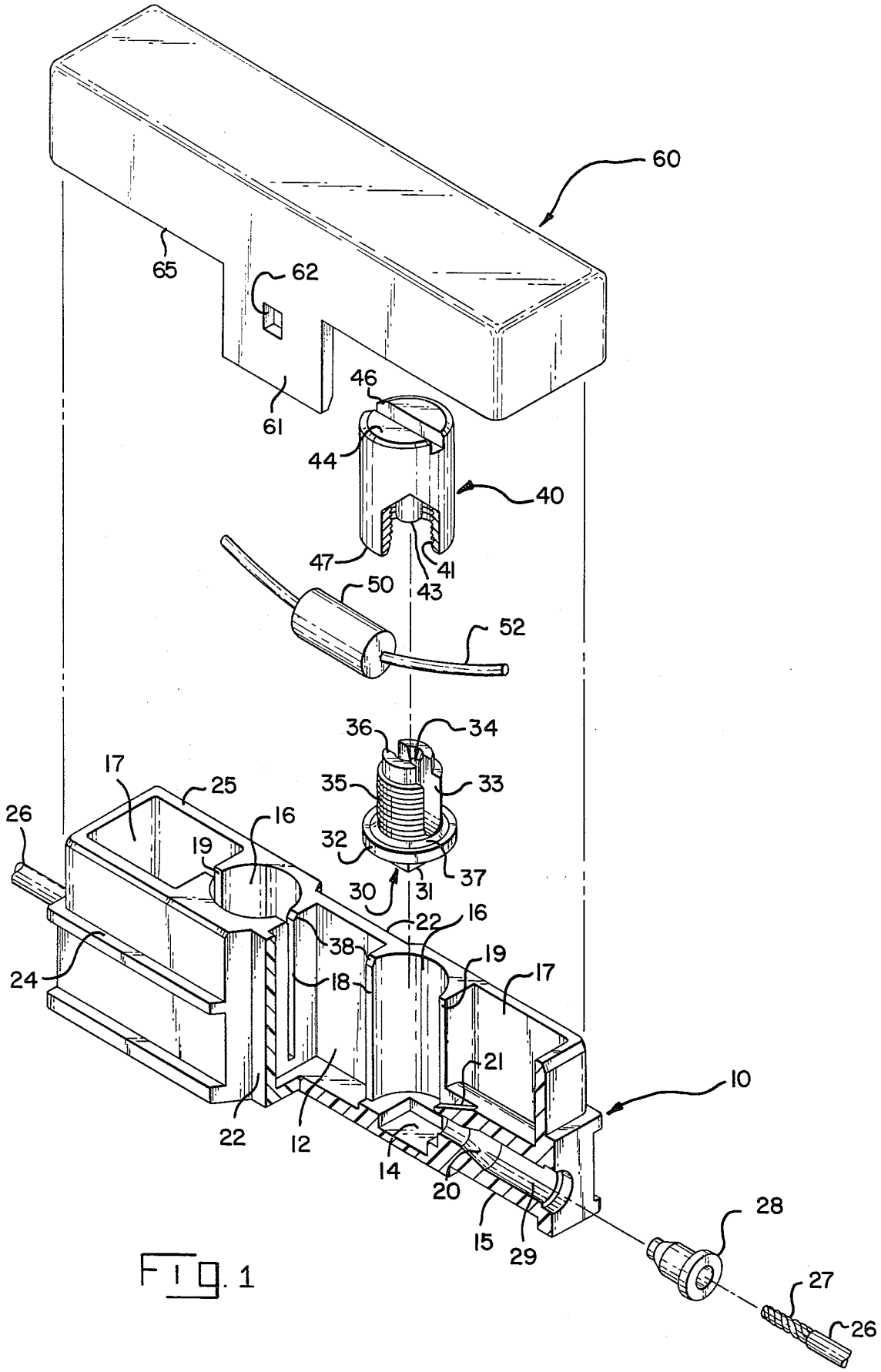
FIG. 1 is an exploded perspective of the connector assembly with the base partially cut away.

The components of the preferred embodiment of the diode connector are shown fully exploded in FIG. 1. A base 10 receives cylindrical posts 30 (only one is shown) which are used to form an in-line termination of diode 50 to insulated conductors 26. The caps 40 secure the termination and the cover 60 snaps into place to protect the terminations from the elements.

The base 10 shown partially cut away in FIG. 1 is profiled with a central compartment 12 with inner slots 18 on either side thereof which communicate between compartment 12 and cylindrical compartments 16 on either side thereof. Each cylindrical compartment 16 has a square receptacle 14 profiled into the bottom thereof, the diagonal dimension of the square being less than the diameter of cylindrical compartment 16. Each cylindrical compartment has an outer slot 19 which communicates with outer compartments 17 via ramps 21. Inner slots 18 and outer slots 19 all lie in the same plane which is situated vertically in the longitudinal center of the base. A counterbore 29 enters each end of the base and communicates with a cylindrical receptacle 16 via funnel entry 20 below the level of outer compartment 17. Outer walls of the base are profiled with a planar recess 22 on either side of central compartment 12 and a planar ledge 24 extending circumferentially about the midsection. A latch tab 23 (FIGS. 3 and 4) is located in each planar recess 22.

Cylindrical posts 30 are identical, each having a square bottom section 31 profiled to fit into square receptacle 14 in the base 10. Above the bottom section 31 is a solid round pedestal 32 of slightly smaller diameter than the cylindrical compartment 16 in base 10. A forty-five degree annular skirt 37 sits on pedestal 32 just below threaded surface 35 which is profiled to form a bolt. A diametric slot 33 through the threaded section 35 extends from top end 36 to just above skirt 37. The slot 33 has a round profile at the bottom thereof and arcuate cuts 34 therein which parallel the axis of the post 30 and are radially symmetric about the axis. The cuts are chamfered where they meet top surface 36.

Referring still to FIG. 1, each cap 40 is hollow and provided with an internal threaded surface 41 profiled to mate with threaded surface 35 on post 30. The bottom edge 47 has an annular forty-five degree chamfer profiled as skirt 37. The top inside surface of the cap has a round dowel 43 extending down the axis of the cap, the dowel being of only slightly smaller radius than that of the arcuate cuts in the slot 33. The top outside surface 44 has a screwdriver slot 46 therein.

Insulated wires 26 are stripped prior to being connected to the diode 50 so that stranded conductive core 27 is exposed. Elastomeric seals 28 are provided which are profiled externally to fit snugly in the counterbores 29 and internally to snugly accommodate the insulated wire 26. The diode 50 is a solid state device having solid wire leads 52 protruding axially from either end thereof. Cover 60 is a box-like rectangular member profiled to fit onto base 10 so that the rim 65 rests close to ledge 24. Side flaps 61 extend down from the lower rim 65 and are each provided with a square hole 62 profiled to fit over latch tab 23.

Figure 2:
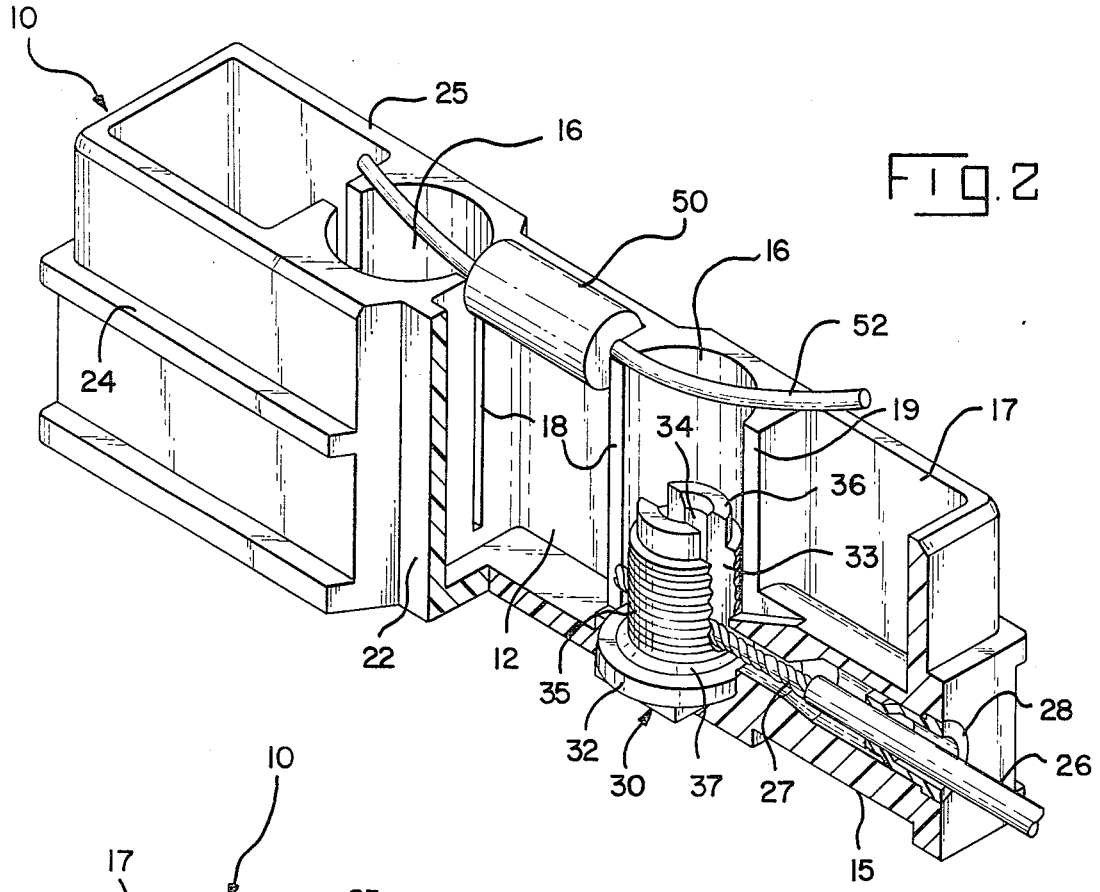
FIG. 2 is a perspective similar to FIG. 1, but partially assembled.

The first assembly step is the installation of the cylindrical posts 30 into the base 10 by slip fitting the square bottom section 31 into the square receptacle 14 so that the slot 33 lines up with the inner and outer slots 18, 19 and rotation is prevented. The seals 28 are installed in the counterbores 29 and the insulated conductors 26 are pushed into the seals 28. The exposed stranded wire 27 is guided by the entry 20 through the bottom portion of slot 33 until it comes to rest against the sides of slot 18, which at 0.040 inch is narrower than wire 27 at 0.065 inch and thus prevents intrusion of wire 27 into central compartment 12. After wires 27 are in place in the bottoms of slots 33, the posts 30 are held in place thereby and the diode 50 is dropped into central compartment 12 such that the diode leads 52 are supported by V-entries 38 in slots 18 over tops of wires 27, as shown in FIG. 2. The compartment 12 is sized so that the ends of the diode 50 are as close as possible to posts 30. The slots 18 at 0.040 inch are narrower than the diode leads 52 at 0.052 inch so that only an interference fit is possible.

Figure 3:
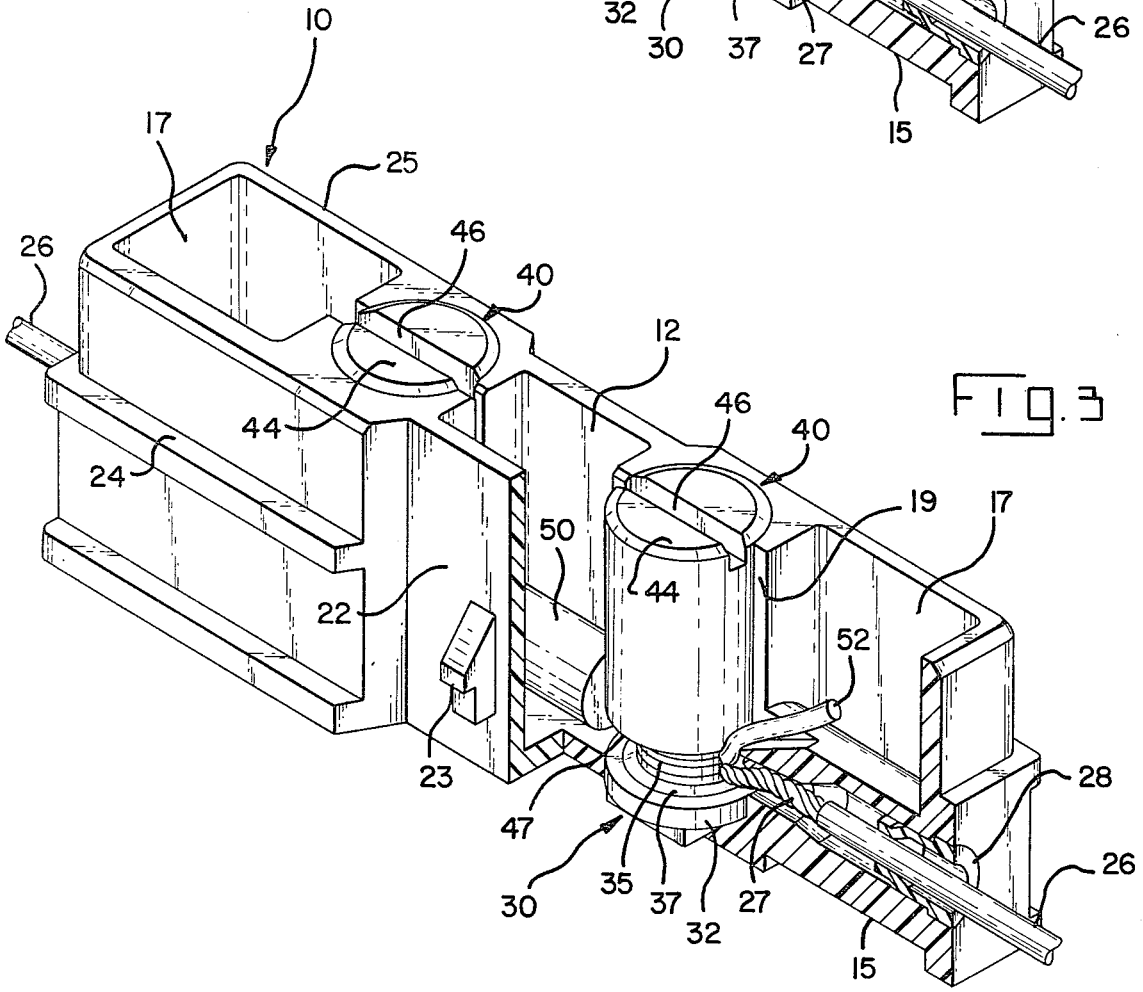
FIG. 3 is a perspective of the assembled connector prior to installing the cover.

After the wires 27 and diode 50 are placed in the position of FIG. 2, the caps 40 are screwed onto the posts so that the bottom edge 47 of each cap 30 drives the diode leads 52 into slots 18 and 19, deforming the walls of slot 18 and pressing the leads 52 against the stranded wire 27 lying in the bottoms of slots 33, as shown in FIG. 3. Latch tab 23 in planar recess 22 is apparent in this view.

Figure 4:
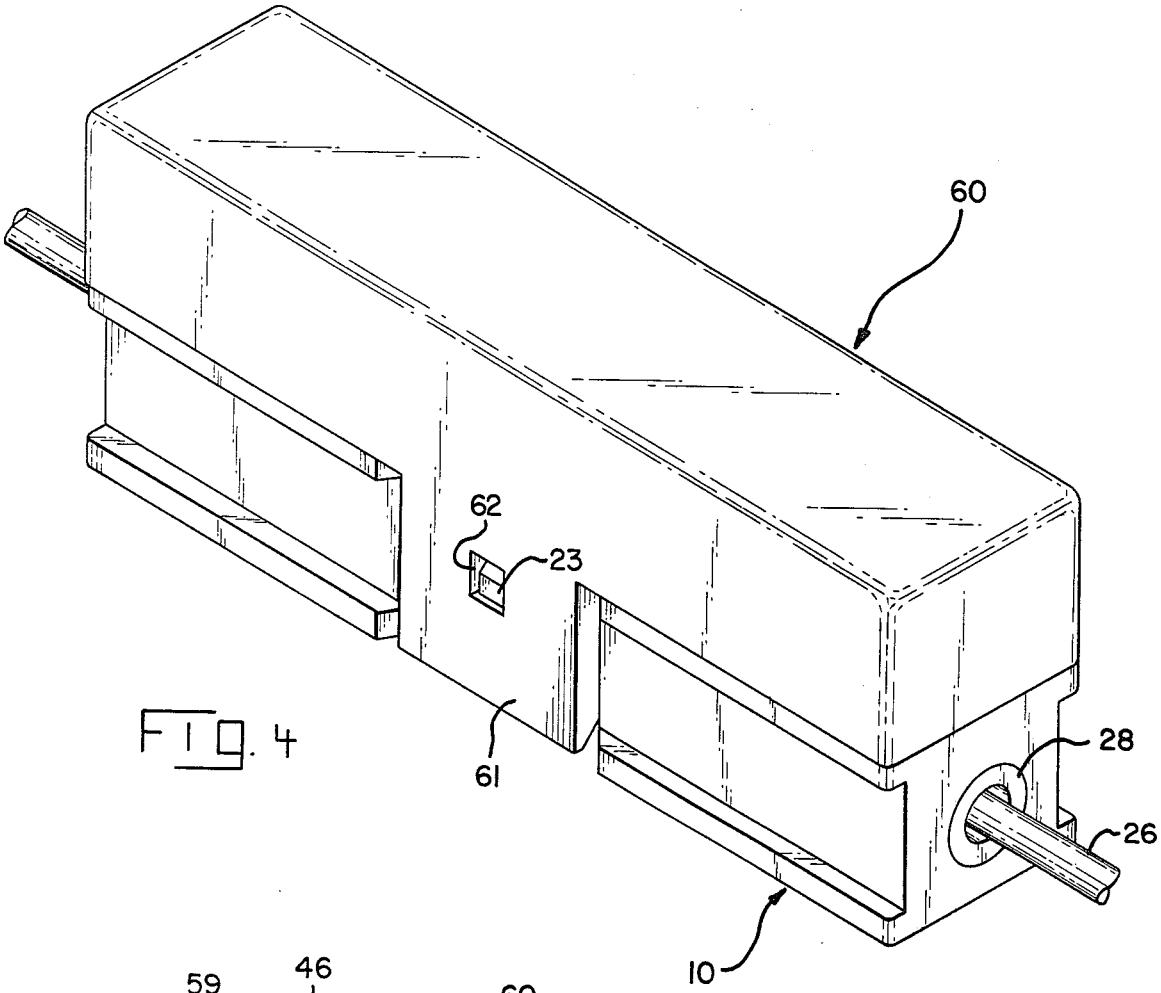
FIG. 4 is a perspective of the assembled connector.

FIG. 4 is a perspective of the fully assembled connector with cover 60 in place. This is accomplished simply by placing the cover 60 over the base 10 with side flaps 61 sliding into planar recesses 22. The flaps 61 flex slightly as they pass latch tabs 23 until the tabs enter apertures 62 in the flaps and the bottom rim 65 of cover 60 abuts ledge 24 on the base 10; the rim 65 then backs off ledge 24 slightly as the pressure required to latch the cover is released. A flat elastomeric gasket 59 (FIG. 5) is placed inside the cover 60 prior to assembly to insure a complete seal when pressed against the top plane 25 of the base 10.

Figure 5:
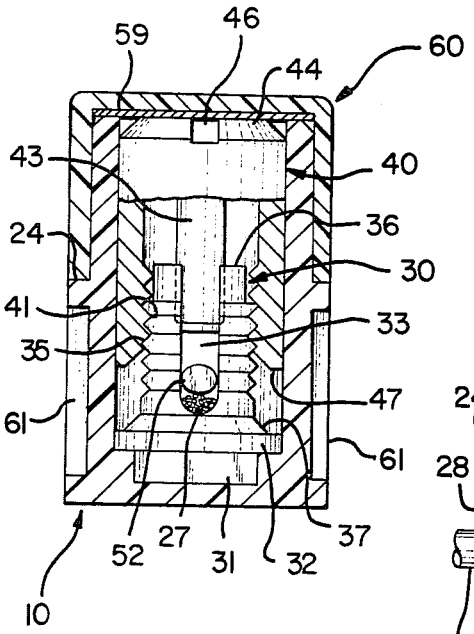
FIG. 5 is an end cross section of the assembled post with cap in place.

FIG. 5 is a cross section of the post and cap assembly after termination. As the caps are screwed down to final position, the downward force of the bottom edge 47 on the leads 52 and wires 27 is offset by the upward force of the top portion of threads in threaded section 41 on the bottom portion of threads in threaded section 35. As the caps are tightly screwed down, the force on the threads 35 causes bending moments about a line through the lower portion of each slot 33, which moments are offsetting and tend to collapse the upper sections of the posts inward over the wires 27 and leads 52 in the bottom portion of the slot 33. Inward collapse of the slot 33 would disengage the upper portion of threads on surfaces 41 and 35 and increase the force on the lower portion of the threads, which could cause material creep on even stripping of threads, which of course is undesirable as it ruins the connector. The solution to the problem is round dowel 43 which is integral with the cap 40 and extends at a right angle thereto along the axis of the cap. The dowel 43 has substantially the same radius as each arcuate cut 34 and thereby prevents collapse of the slot 33 as the cap is screwed down.

Figure 6:
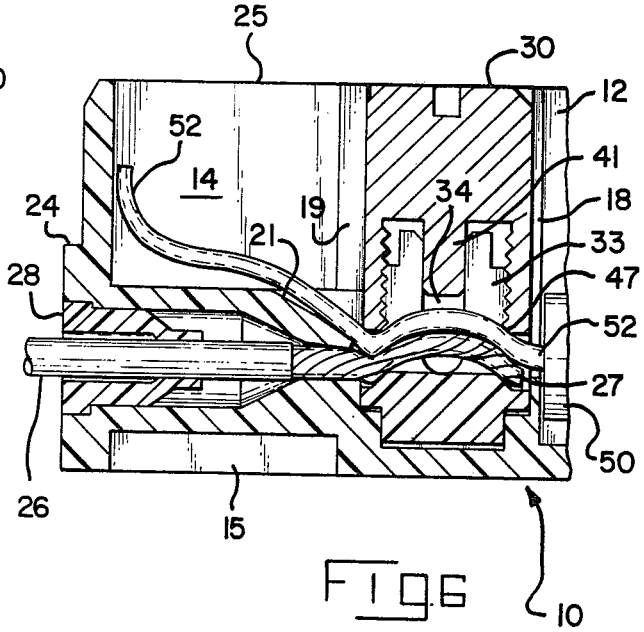
FIG. 6 is a side cross section of the assembled post and cap in place.

FIG. 6 is a cross section of the post and cap assembly in the housing 10 after termination, taken along the plane of slot 33. Note that the chamfered bottom edge 47 of the cap parallels the skirt 37 of the post and bend the leads 52 and wires 27 on either side of slot 33. This provides strain relief to prevent the wires 27 from being readily removed, and further mashes the leads 52 into wires 27 to form a gas tight seal, which prevents oxidation which could interfere with thermal and electrical contact. Note that each lead 52 passes through a slot 19 and up ramp 21 into outer compartment 17. The lead 52 can be stuffed in this compartment which precludes the need to trim the lead before inserting the diode and further provides ready access to the lead if the diode has to be removed. This is desirable due to the interference fit of lead 52 in slot 18 which necessitates an upward pull. Slot 19 holds lead 52 on top of wire 27 as the cap 40 is screwed down and prevents it from being skewed to the side, which insures an even distribution of forces and makes it difficult to remove the diode.

The arrangement of binding post type terminations with slots therein along the central plane of the connector assembly permits a narrow profile for the assembly, and allows a design with the post and cap assemblies closer to the diode 50 than a screw type terminal, and also permits the wire 27 to be terminated more closely to the diode body. This is important since a high current diode generates a lot of heat which can be destructive to the semiconductor if not dissipated. As the best avenue for heat dissipation is by conduction through leads 52, it is advantageous to have heat sinks on the leads as close as possible to the diode. The post and cap assemblies as arranged in the base 10 of the present invention present a geometry which theoretically permit the power dissipating elements to be situated in closest proximity to the diode junction and thus allow good heat dissipation. The cylindrical receptacles 16, in turn, are profiled to closely receive the caps 40 and thus provide dissipation from the post and cap assemblies to the base by conduction rather than by radiation or convection through air. The post and cap assemblies are manufactured from die cast metal of high thermal conductivity and thus are readily heated by the diode. The base is of a dielectric material and thus of lower thermal conductivity than a metal, but nevertheless the almost complete contact with the terminal provides effective dissipation. The terminals are relatively massive as compared to the housing and cover which takes advantage of an interesting principle: heat dissipation is actually improved by addition of an insulator, provided the insulator has a large radiant surface and is relatively thin walled. Thus cavity 15 on the bottom may be profiled with cooling fins to further dissipation.

An alternative embodiment of the invention would utilize a base having a top plane substantially below the top surface of the caps as assembled to the posts. The cover is modified to incorporate round holes through which the caps fit so they are exposed to outside air for heat dissipation by radiation and convection. Seals in the apertures are provided to keep out moisture from the environment and dielectric grating may be provided over the exposed portion of the caps to prevent accidental electrical shorting. Short circuiting by rain water is eliminated by baffles and non-collective surfaces. Reinforcing ribs may also be molded in the cover to add stiffness to insure a complete contact between the cover and the base.

In use, the diodes are wired to shunt current across a solar panel in the event of cell failure. The covers are mounted to the bottom of a panel so the base and adjoining wires may be readily snapped out in the event service is required. An environmentally sealed diode connector is also desirable for marine applications.

The foregoing description is exemplary and not intended to limit the scope of the claims which follow.

What is claimed is:

1. A connector for terminating an in-line electrical device such as a diode having a pair of opposed leads protruding therefrom to a pair of external wires comprising:

a base having a central compartment which receives said device and a pair of opposed cylindrical compartments on either side thereof located closely thereto, said base further having a pair of opposed inner slots between said central compartment and cylindrical compartments, said inner slots being profiled to permit insertion of said leads, said base further having entries on opposite sides of said cylindrical compartments from said inner slots, said entries each being profiled to permit insertion of one of said external wires, a pair of threaded cylindrical metal posts each mounted in a respective cylindrical compartment, each post having a diametric slot extending axially into the top thereof, said slots being aligned with respective inner slots and entries on either side thereof, a pair of hollow internally threaded cylindrical metal cap members, said caps being profiled to thread onto said posts, said caps being closely received in respective cylindrical compartments, whereby, a device placed in said central compartment with said opposed leads extending through said inner slots and into said diametric slots in said posts and terminated to said external wires passing through said entries and into said diametric slots by screwing said caps onto said posts to secure said wires and leads therein will provide a short thermal path from said device to said posts and caps, which act as heat sinks, and heat will be dissipated by conduction through said external wires and through said caps to said base.

2. A connector as in claim 1 which further comprises a cover mountable to said base, said cover being profiled to protect the diode, leads, and wires from intrusion of moisture, said connector thus being suitable for outdoor use.

3. The connector of claim 2 wherein said cover has a pair of holes therein profiled to fit over said cap members, said cover having seals at the periphery of said holes to prevent intrusion of moisture, whereby said portions of said cap members are exposed for improved heat dissipation.

4. The device of claim 1 wherein said inner slots are narrower than the diameter of said wires whereby said wires may be inserted into said entries and through said slots in said posts without extending into said central compartment.

5. The device of claim 4 wherein said base is of deformable material, said inner slots being narrower than the diameter of said leads but wide enough to permit an interference fit, whereby said leads may be forced into said inner slots by screwing down said cap members.

6. The device of claim 1 wherein said base is profiled with a pair of outer compartments on opposite sides of said cylindrical compartments from said central compartment, said base further having a pair of outer slots profiled therein between said cylindrical compartments and said outer compartments opposite said inner slots, said outer slots being aligned with said slots in said posts to permit passage of said leads therethrough, said outer slots being sized to accommodate said leads, said outer compartments being separated from said wire entries, whereby said leads may be inserted into said slots in said posts without being trimmed, excess length passing through said outer slots and being stuffable into said outer compartments.

7. The device of claim 6 wherein said outer slots each have a ramp at the bottom thereof which cants from a point adjacent to said slot in said post and immediately above said wire entry up into the respective outer compartment, whereby leads passing from the post and cap assemblies through said outer slots will cant upward into said outer compartments to improve access to the leads and facilitate removal of the device.

8. The device of claim 1 wherein said hollow cap members each have a round dowel located axially therein, said dowel being sized to fit snugly in the middle of said diametric slot, whereby inward collapse of said slot is prevented when said cap member is screwed onto the post.

9. The device of claim 8 wherein each said post has a pair of opposed arcuate cuts in the walls of said slot, said cuts having radial symmetry about the axis of the post and being of substantially the same radius as the dowel.

10. A binding post type electrical connector comprising a threaded cylindrical post having a wire receiving diametric slot extending axially into one end thereof and an internally threaded hollow cap member profiled to screw thereon, said cap member having a round dowel located axially therein, said round dowel being sized to fit snugly in the middle of said diametric slot, whereby inward collapse of said slot is prevented when said cap member is screwed onto the post, said post having an angled skirt extending away from said one end immediately below the bottom of said diametric slot, said cap member having a bottom edge chamfered to parallel said skirt as said cap is screwed on said post, said dowel extending only partially into said slot, whereby a wire passing through said slot in said post will be bent at an angle as said cap is screwed down to provide better retention of said wire in said terminal.

* * * * *